US009573247B2

(12) United States Patent
Egawa et al.

(10) Patent No.: US 9,573,247 B2
(45) Date of Patent: Feb. 21, 2017

(54) SHOT PEENING METHOD

(71) Applicant: TOYOTA JIDOSHA KABUSHIKI KAISHA, Toyota-shi (JP)

(72) Inventors: Tetsuji Egawa, Okazaki (JP); Takashi Umehara, Nissin (JP); Hiromi Tomoto, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/959,578

(22) Filed: Dec. 4, 2015

(65) Prior Publication Data

US 2016/0158914 A1 Jun. 9, 2016

(30) Foreign Application Priority Data

Dec. 8, 2014 (JP) ..... 2014-248156

(51) Int. Cl.

| | |
|---|---|
| ***B21J 5/00*** | (2006.01) |
| ***B24C 1/10*** | (2006.01) |
| ***C21D 7/06*** | (2006.01) |

(52) U.S. Cl.

CPC .. *B24C 1/10* (2013.01); *B21J 5/00* (2013.01); *C21D 7/06* (2013.01)

(58) Field of Classification Search

CPC ..... B24C 1/10; C21D 7/06; B21J 5/00
USPC ..... 72/53; 29/90.7; 451/38, 39
See application file for complete search history.

(56) References Cited

U.S. PATENT DOCUMENTS

| | | | | |
|---|---|---|---|---|
| 2,701,408 | A * | 2/1955 | Borger | B21D 31/06 451/101 |
| 3,000,425 | A * | 9/1961 | Hodges | B21D 31/06 217/1 |
| 3,705,510 | A * | 12/1972 | Baughman | B64F 1/04 72/53 |
| 3,705,511 | A * | 12/1972 | Brandel | C21D 7/06 72/53 |
| 5,072,606 | A * | 12/1991 | Koehler | B24C 1/10 29/90.7 |
| 6,264,771 | B1 * | 7/2001 | Bornschlegl | B24C 1/10 148/697 |
| 7,181,944 | B2 * | 2/2007 | Wuestefeld | B21D 11/085 29/90.7 |

FOREIGN PATENT DOCUMENTS

| | | |
|---|---|---|
| JP | 52-99961 | 8/1977 |
| JP | 07-155841 A | 6/1995 |
| JP | 2004-130368 A | 4/2004 |
| JP | 2006-312176 | 11/2006 |
| JP | 2011-31286 | 2/2011 |
| JP | 2013-208622 | 10/2013 |
| JP | 2014-73500 | 4/2014 |

* cited by examiner

*Primary Examiner* — David B Jones
(74) *Attorney, Agent, or Firm* — Oblon, McClelland, Maier & Neustadt, L.L.P.

(57) ABSTRACT

A method of shot peening according to the present invention includes: placing a jig having an appropriate dimension at one face side of a stamped workpiece; and performing shot peening on another face side of the workpiece in a state where the jig is placed at the one face side of the workpiece, and conforming the workpiece to the jig. At this time, the shot peening may be performed in such a way that residual stresses in the inner side and the outer side of the curved part of the workpiece will become compressive stresses.

7 Claims, 16 Drawing Sheets

11
θ

11
14
12

11
18
13
16
14
12

15
12

15

BEFORE FORMATION

BOTTOM DEAD CENTER

AFTER FORMATION

BOTTOM DEAD CENTER REPRODUCED

NO SHOT PEENING

SHOT PEENED

SHOT PEENING METHOD

INCORPORATION BY REFERENCE

This application is based upon and claims the benefit of priority from Japanese patent application No. 2014-248156, filed on Dec. 8, 2014, the disclosure of which is incorporated herein in its entirety by reference.

BACKGROUND OF THE INVENTION

1. Field of the Invention

The present invention relates to a shot peening method.

2. Description of Related Art

One of the techniques for bending a metal plate is stamping. Stamping is a technique in which an upper die and a lower die sandwich a workpiece and bend the workpiece. Japanese Unexamined Patent Application Publication No. 2006-312176 discloses a technique for stamping a metal plate, in particular, a technique for preventing springback in a metal plate which has been bent.

Further, one of the metal processing techniques is shot peening. Shot peening is a type of cold working and is a technique for improving fatigue strength under repeated loading by causing a shot material which is iron or non-ferrous metal spheres to hit a metal surface at a high speed.

As described above, when a metal plate (a workpiece) is stamped, the workpiece is sandwiched by an upper die and a lower die and then bent. At this time, springback, which is a phenomenon in which a part which has been bent tending to return to its original shape, may occur. Moreover, the workpiece itself may twist after being stamped. The present inventor has found a problem that when the springback or twist occurs in the stamped workpiece, a form accuracy of the stamped workpiece is lowered.

SUMMARY OF THE INVENTION

In light of the above-described problem, the present invention aims to improve a form accuracy of a stamped workpiece by shot peening.

An aspect of the present invention is a method of shot peening that includes: placing a jig having an appropriate dimension at one face side of a stamped workpiece; and performing shot peening on another face side of the workpiece in a state where the jig is placed at the one face side of the workpiece, and conforming the workpiece to the jig.

As mentioned above, in the method of shot peening according to the present invention, in a state where the jig having the appropriate dimension is placed at the one face side of the workpiece, the shot peening is performed on the other face side of the workpiece to conform the workpiece to the jig. It is thus possible to correct springback and twist that is generated in the stamped workpiece. Accordingly, the form accuracy of the stamped workpiece can be improved.

According to the present invention, the form accuracy of the pressed workpiece can be improved by the shot peening.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Hereinafter, an exemplary embodiment of the present invention shall be explained as follows with reference to the drawings.

FIGS. 1A to 1E are cross-sectional diagrams for explaining processes of a shot peening method according to the exemplary embodiment. In this exemplary embodiment, the shot peening is performed on a stamped workpiece in order to improve a form accuracy of the stamped workpiece. The processes shall be explained in detail as follows.

Figures 1A, 1B, 1C, 1D, 1E:
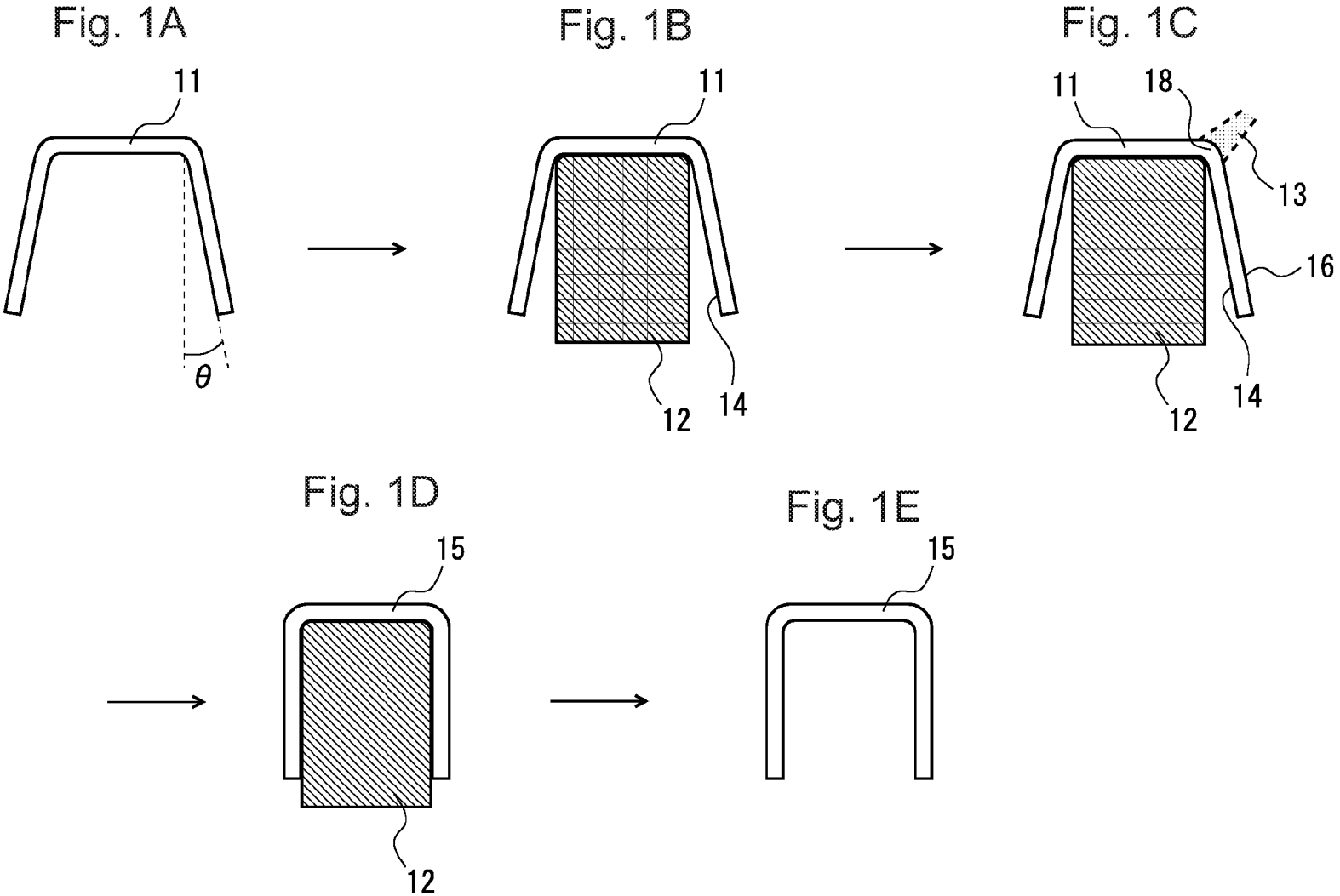
FIGS. 1A to 1E are cross-sectional diagrams for explaining processes of a shot peening method according to an exemplary embodiment.

Firstly, as shown in FIG. 1A, a stamped workpiece 11 is prepared. The workpiece 11 is formed by sandwiching a metal plate by two dies (e.g. an upper die and a lower die) and stamping the workpiece. Springback, which is a phenomenon in which a part which has been bent tending to return to its original shape, is generated in the stamped workpiece 11, and a side part of the workpiece 11 is deviated from an appropriate dimension by an angle θ. Note that in FIGS. 1A to 1E, although the workpiece 11 has a U-shape in cross-section as an example, the shape of the workpiece is not limited to this.

Next, as shown in FIG. 1B, a jig 12 having the appropriate dimension is placed at one face side of the stamped workpiece 11 (i.e., an inner side 14 of the workpiece 11). The jig 12 is formed of a metal material or the like. An outer periphery of the jig 12 corresponds to a shape which the inner side 14 of the workpiece 11 should form. As shown in FIG. 1B, the springback is generated in the stamped workpiece 11. Thus, there are gaps between side faces of the jig 12 and the inner sides 14 of the workpiece 11. The jig 12 is prepared, for example, separately from a die that is used for the stamping.

Next, as shown in FIG. 1C, in a state where the jig 12 is placed at the one face side of the workpiece 11 (i.e. the inner side 14 of the workpiece 11), shot peening 13 is performed on another face side of the workpiece 11 (i.e. an outer side 16 of the workpiece 11), and the workpiece 11 is conformed to the jig 12. In this case, as springback is generated in the workpiece 11, the shot peening 13 is performed in the vicinity of a curved part 18 which is a part for causing the springback.

Figure 2:
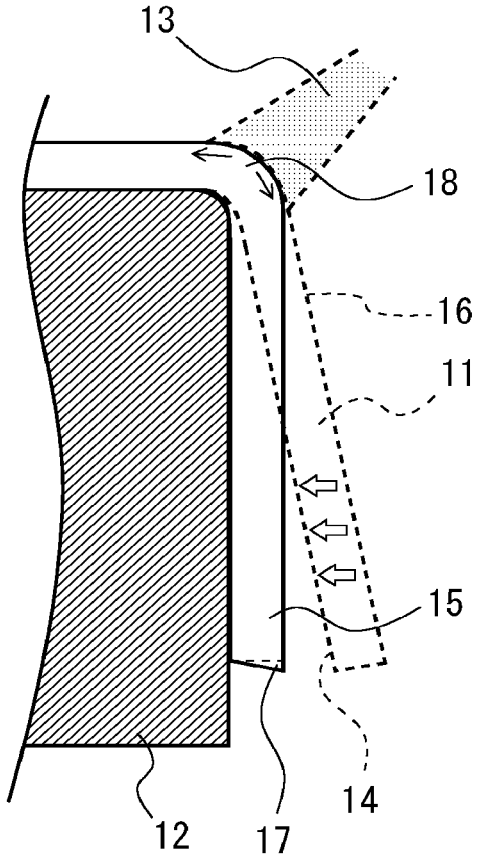
FIG. 2 is a cross-sectional diagram for explaining the shot peening method according to the exemplary embodiment.

By performing the shot peening 13 on the workpiece 11 in this way, as shown in FIG. 1D, an inner side of a workpiece 15 (the shot-peened workpiece shall be referred to as the workpiece 15) can be conformed to the outer periphery of the jig 12. FIG. 2 is a cross-sectional diagram for explaining the shot peening method according to the exemplary embodiment and shows a state before and after performing the shot peening 13 (corresponding to FIGS. 1C and 1D).

As shown in FIG. 2, as the springback is generated in the workpiece 11 which is the workpiece before the shot peening is performed, a gap is generated between the side face of the jig 12 and the inner side 14 of the workpiece 11. When the shot peening 13 is performed in the vicinity of the curved part 18 of the workpiece 11, the outer side 16 of the curved part 18 of the workpiece 11 is plastically deformed, and the outer side 16 of the curved part 18 is extended. Then, the side part of the workpiece 11 is displaced inwardly (i.e. displaced to the side of the jig 12 which is indicated by arrows). After that, at a timing when the inner side 14 of the workpiece 15 is brought into contact with and conformed to the outer periphery of the jig 12, the shot peening 13 is ended. When the shot peening 13 is performed on the outer side 16 of the workpiece 15, the outer side 16 of the workpiece 15 is extended, and thus an outer side of a tip 17 of the side part of the workpiece 15 is slightly extended downwardly.

After the shot peening 13 is performed, the workpiece 15 and the jig 12 are separated as shown in FIG. 1E. By the processes shown in FIGS. 1A to 1E explained above, the springback in the stamped workpiece 11 can be corrected, thereby improving the form accuracy of the workpiece.

Next, the shot peening shall be explained in detail as follows. The shot peening is a type of cold working and is a process that causes a shot material which is iron or non-ferrous metal spheres to hit a metal surface at a high speed. One example of conditions of the shot peening is that: a diameter of the shot material is about ϕ2.5 mm, a hardness of the shot material (Rockwell hardness) is about HRc 40 to 50, a shot pressure is about 0.3 MPa, a diameter of a nozzle for discharging the shot material is about ϕ10 mm, and an irradiated area is about ϕ25 mm. Note that these conditions are an example, and the shot peening method according to this exemplary embodiment may impose conditions other than these mentioned above.

Figure 3:
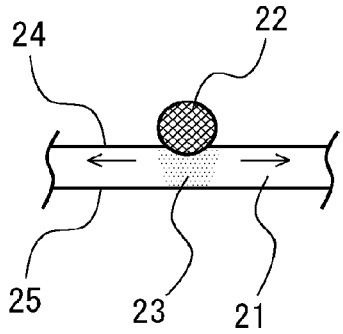
FIG. 3 is a cross-sectional diagram for explaining the shot peening method according to the exemplary embodiment.

FIG. 3 is a cross-sectional diagram for explaining the shot peening method according to this exemplary embodiment and shows a state of the shot peening when a load applied by a shot material 22 on a workpiece 21 (hereinafter also referred to as a shot force) is low. As shown in FIG. 3, when the shot material 22 hits the workpiece 21, the workpiece 21 is plastically deformed. A region that is plastically deformed at this time shall be indicated by a reference numeral 23. When the shot force of the shot material 22 is weak, the plastically deformed region 23 when the shot material 22 hits the workpiece 21 will become the one shown in FIG. 3 in which an upper face 24 of the workpiece 21 is horizontally extended more than a lower face 25 of the workpiece 21 is. In other words, when the shot force of the shot material 22 is weak, the upper face 24 of the workpiece 21 is preferentially extended. The conditions of the shot peening in this case are, for example, the conditions in which an impression depth on a surface (the upper face 24) of the workpiece 21 will become more than or equal to 0.1 mm and less than 0.3 mm.

When the shot force of the shot material 22 is weak as in the above case, the upper face 24 of the workpiece 21 is extended. Therefore, a shot peening process under such conditions can be executed in a case where, as shown in the left drawing of FIG. 4, when a jig 32 is placed at an inner side of a curved part of a workpiece 31, a gap is formed between an inner side 34 of the workpiece 31 and an outer periphery of the jig 32, that is, when a radius of curvature of the curved part of the workpiece 31 is greater than that of a curved part of the jig 32.

Figure 4:
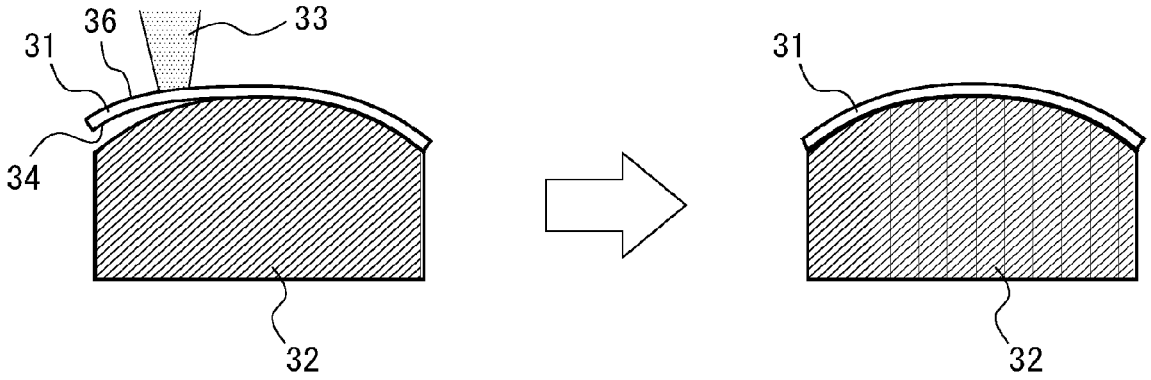
FIG. 4 is a cross-sectional diagram for explaining the shot peening method according to the exemplary embodiment.

Then, when shot peening 33 is performed on an outer side 36 of the workpiece 31, as the outer side 36 of the workpiece 31 is extended more than the inner side 34 of the workpiece 31 is, the inner side 34 of the workpiece 31 can be conformed to the outer periphery of the jig 32, as shown in the right drawing of FIG. 4.

Figure 5:
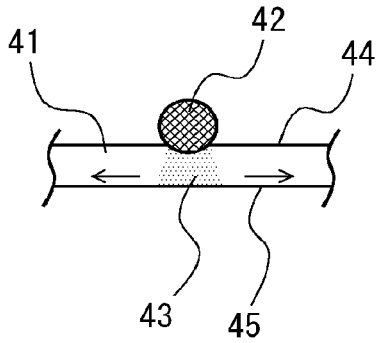
FIG. 5 is a cross-sectional diagram for explaining the shot peening method according to the exemplary embodiment.

FIG. 5 is a cross-sectional diagram for explaining the shot peening method according to this exemplary embodiment and shows a state of the shot peening when a load applied by a shot material 42 on a workpiece 41 (a shot force) is high. As shown in FIG. 5, when the shot material 42 hits the workpiece 41, the workpiece 41 is plastically deformed. A region that is plastically deformed at this time shall be indicated by a reference numeral 43. When the shot force of the shot material 42 is strong, the plastically deformed region 43 when the shot material 42 hits the workpiece 41 will become the one shown in FIG. 5 in which a lower face 45 of the workpiece 41 is horizontally extended more than an upper face 44 of the workpiece 41 is. In other words, when the shot force of the shot material 42 is strong, the lower face 45 of the workpiece 41 is preferentially extended. The conditions of the shot peening in this case are, for example, the conditions in which an impression depth on a surface (the upper face 44) of the workpiece 41 will become more than or equal to 0.3 mm.

When the shot force of the shot material 42 is strong as in the above case, the lower face 45 of the workpiece 41 is extended. Therefore, a shot peening process under such conditions can be executed in a case where, as shown in the left drawing of FIG. 6, when a jig 52 is placed at an outer side 56 of a curved part of a workpiece 51, a gap is formed between the outer side 56 of the workpiece 51 and an outer periphery of the jig 52, that is, when a radius of curvature of the curved part of the workpiece 51 is greater than that of a curved part of the jig 52.

Figure 6:
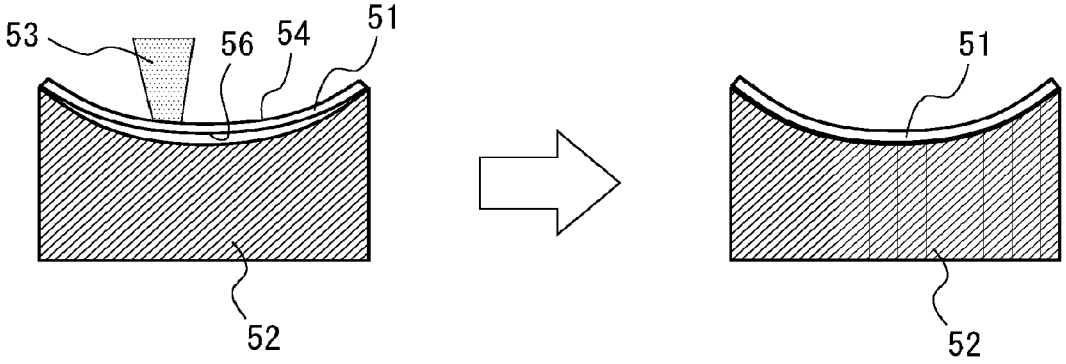
FIG. 6 is a cross-sectional diagram for explaining the shot peening method according to the exemplary embodiment.

Then, when shot peening 53 is performed on an inner side 54 of the workpiece 51, as the outer side 56 of the workpiece 51 is extended more than the inner side 54 of the workpiece 51 is, the outer side 56 of the workpiece 51 can be conformed to the outer periphery of the jig 52, as shown in the right drawing of FIG. 6. Note that the inner side 54 of the workpiece 51 is a side in which there is a center point of a circle when the curved part of the workpiece 51 is approximated to the circle.

As has been explained above, in this exemplary embodiment, a state of the workpiece displacement can be changed by changing the shot force to be applied on the workpiece. It is thus possible to appropriately conform the workpiece to the jig by adjusting the shot force depending on a positional relationship between the workpiece and the jig.

Figure 7:
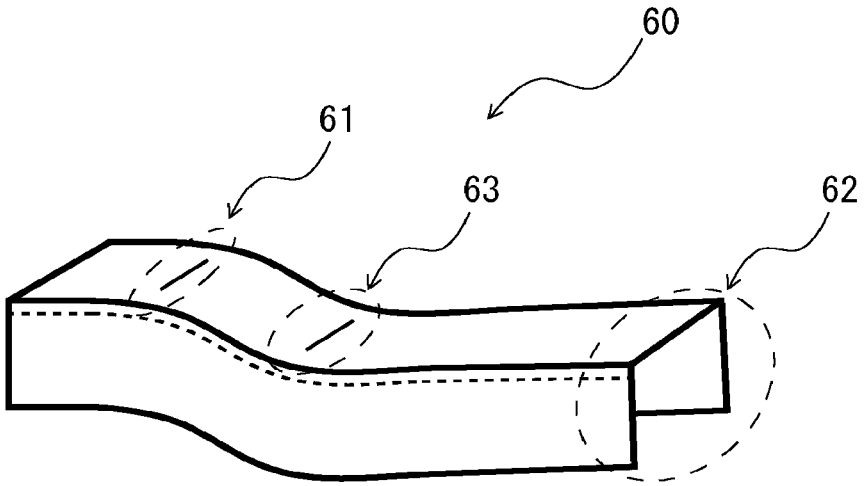
FIG. 7 is a perspective diagram showing a workpiece which will be shot peened.
Figures 8A, 8B, 8C:
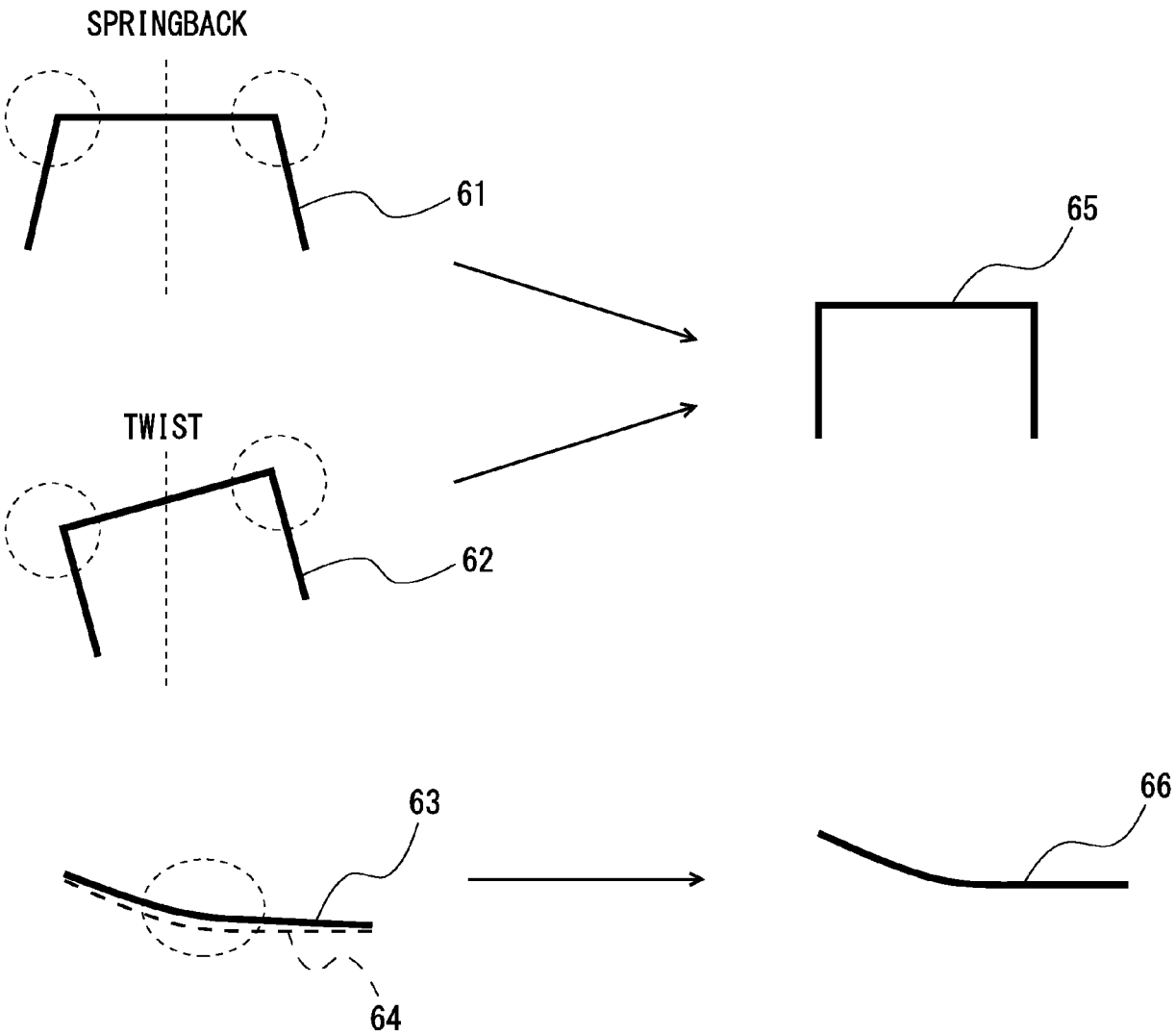
FIGS. 8A to 8C are cross-sectional diagrams showing workpieces to be shot peened.

Next, an example in which the shot peening is performed on a stamped workpiece shall be explained as follows. FIG. 7 is a perspective diagram showing a workpiece which will be shot peened, i.e. the stamped workpiece. FIGS. 8A to 8C are cross-sectional diagrams showing workpieces which will be shot peened.

As to a workpiece 60 shown in FIG. 7, a shape thereof is deviated from an appropriate dimension due to an influence such as the springback and twist after the stamping. For example, the springback is generated at a part indicated by a reference numeral 61, as shown in the cross-sectional diagram of FIG. 8A. In this case, shot peening (shot peening with a weak shot pressure. See FIGS. 3 and 4) focusing on a curved part (indicated by a dashed line) of the workpiece 61 is performed. This corrects the springback generated in the workpiece 61, thereby forming the workpiece 61 to become a workpiece 65 with an appropriate dimension.

Further, a twist is generated at a part indicated by a reference numeral 62 in FIG. 7, as shown in the cross-sectional diagram of FIG. 8B. In a manner similar to that of the above case, shot peening focusing on a curved part (indicated by a dashed line) of a workpiece 62 is performed. This corrects the springback generated in the workpiece 62, thereby forming the workpiece 62 to become the workpiece 65 with the appropriate dimension.

Furthermore, a workpiece 63 is deviated from the appropriate dimension (indicated by a reference numeral 64) at a part indicated by a code 63 in FIG. 7, as shown in the cross-sectional diagram of FIG. 8C. In this case, shot peening (shot peening with a strong shot pressure. See FIGS. 5 and 6) focusing on a curved part (indicated by a dashed line) of the workpiece 63 is performed. This corrects the curved part of the workpiece 63, thereby forming the workpiece 63 to become a workpiece 66 with an appropriate dimension.

Further, in this exemplary embodiment, a stress to form the stamped workpiece to become the workpiece with the appropriate dimension may be calculated using a dimensional difference from the appropriate dimension of the stamped workpiece, and the shot peening may be performed under conditions that the calculated stress is applied on the stamped workpiece. FIGS. 9A to 9D are cross-sectional diagrams for explaining a method for calculating the stress to form the stamped workpiece to become the workpiece with the appropriate dimension. FIG. 10 is a graph for explaining the method for calculating the stress to form the stamped workpiece to become the workpiece with the appropriate dimension and shows a relationship between a strain and stress of the workpiece.

Figure 9A:
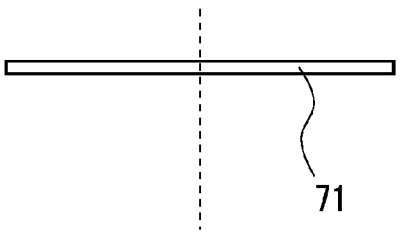
FIGS. 9A to 9D are cross-sectional diagrams for explaining a method to calculate a stress to form a stamped workpiece to become a workpiece with an appropriate dimension.
Figure 9B:
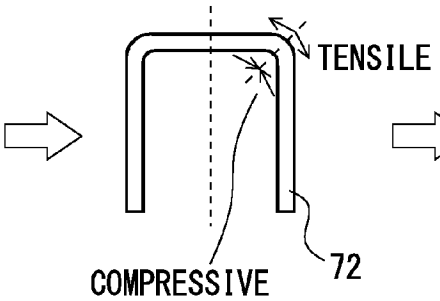
Figure 9C:
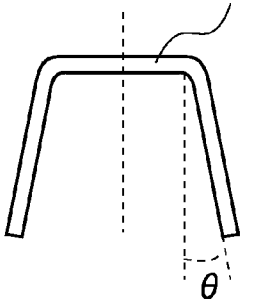
Figure 10:
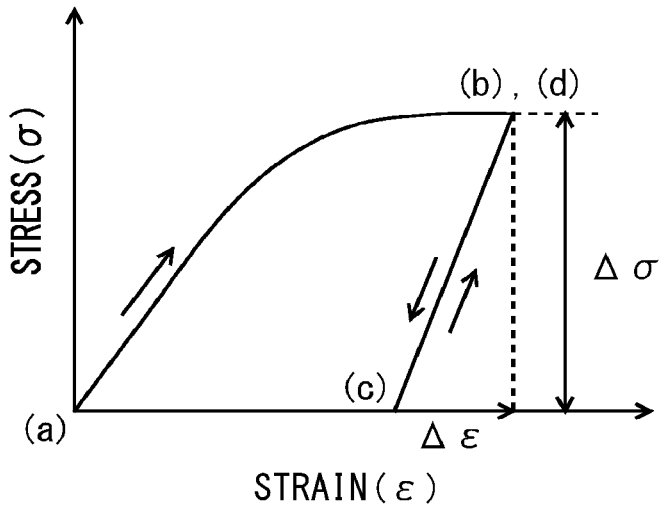
FIG. 10 is a graph for explaining the method to calculate the stress to form the stamped workpiece to become the workpiece with the appropriate dimension.

As shown in FIG. 9A, the strain and stress in an unstamped workpiece 71 are zero (see (a) in FIG. 10). Then, as shown in FIG. 9B, when the workpiece is sandwiched by an upper die and a lower die (the upper die and the lower die are not shown), pressed to a bottom dead center, and restrained, a tensile stress is generated in an outer side of a curved part of a workpiece 72, and a compressive stress is generated in an inner side of the curved part of the workpiece 72. The relationship between the strain and stress applied on the curved part of the workpiece 72 is indicated by (b) in FIG. 10. Then, as shown in FIG. 9C, when the workpiece is removed from the die, the springback is generated in a workpiece 73, causing a side part of the workpiece 73 to be deviated from an appropriate dimension by an angle θ. At this time, as indicated by (c) in FIG. 10, no stress is applied on the workpiece.

Figure 9D:
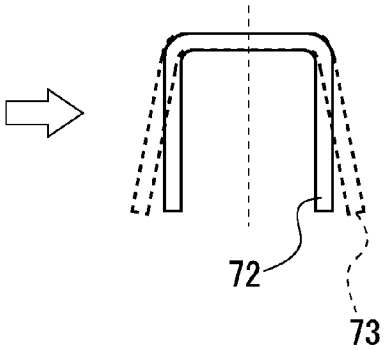

After that, a strain gauge is attached to a side part of the workpiece 73, an external force is applied on the side part of the workpiece 73, and the bottom dead center is reproduced as shown in FIG. 9D. This state corresponds to a state in which the workpiece is sandwiched by the upper die and the lower die and pressed to the bottom dead center (the state of FIG. 9B). As the strain measured at this time is $\Delta\epsilon$, the stress $\Delta\sigma$ generated in the curved part of the workpiece 72 can be calculated by an expression $\Delta\sigma=\Delta\epsilon\times E$. In this expression, E is a Young's modulus of the workpiece.

In this expression, $\Delta\sigma$ corresponds to a stress when the springback is generated and is equivalent to a stress generated in the workpiece in a state where the workpiece is sandwiched by the upper die and the lower die and restrained. In this exemplary embodiment, the shot peening may be performed under conditions to cancel out this $\Delta\sigma$. Specifically, a stress to form the stamped workpiece to become the workpiece with the appropriate dimension (a stress obtained by inverting a sign of $\Delta\sigma$) may be calculated, and the shot peening may be performed under conditions that the calculated stress is applied on the stamped workpiece.

Figure 11:
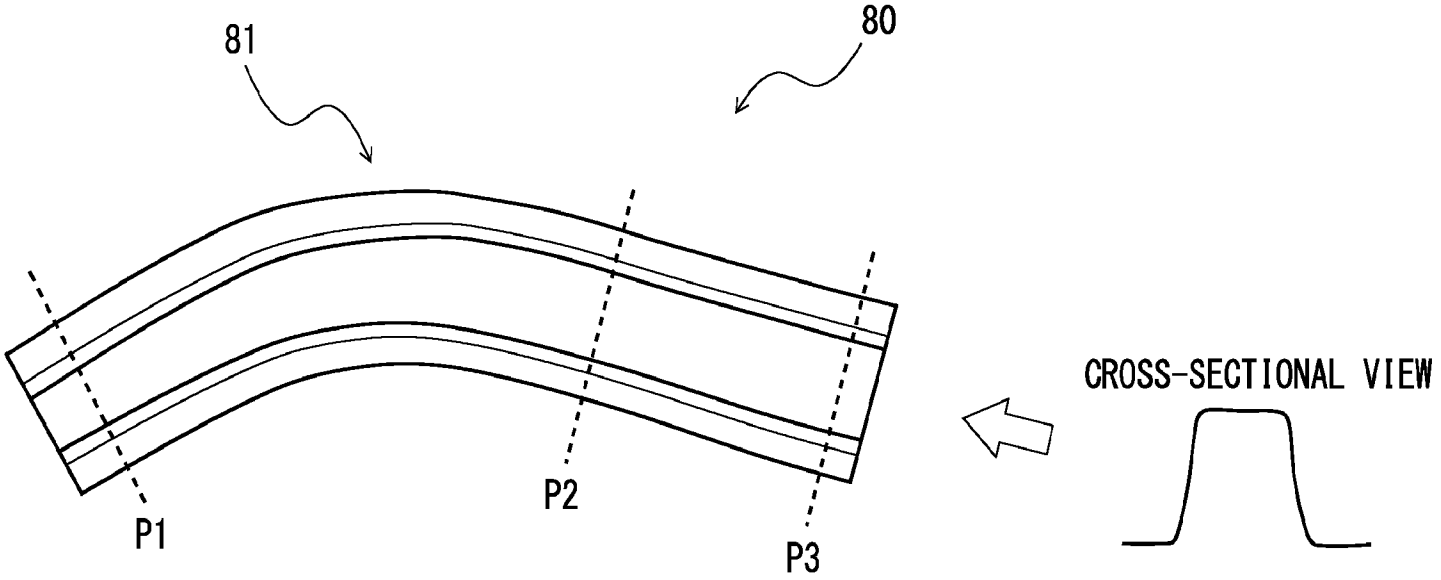
FIG. 11 is a diagram showing an example of a workpiece.
Figure 12:
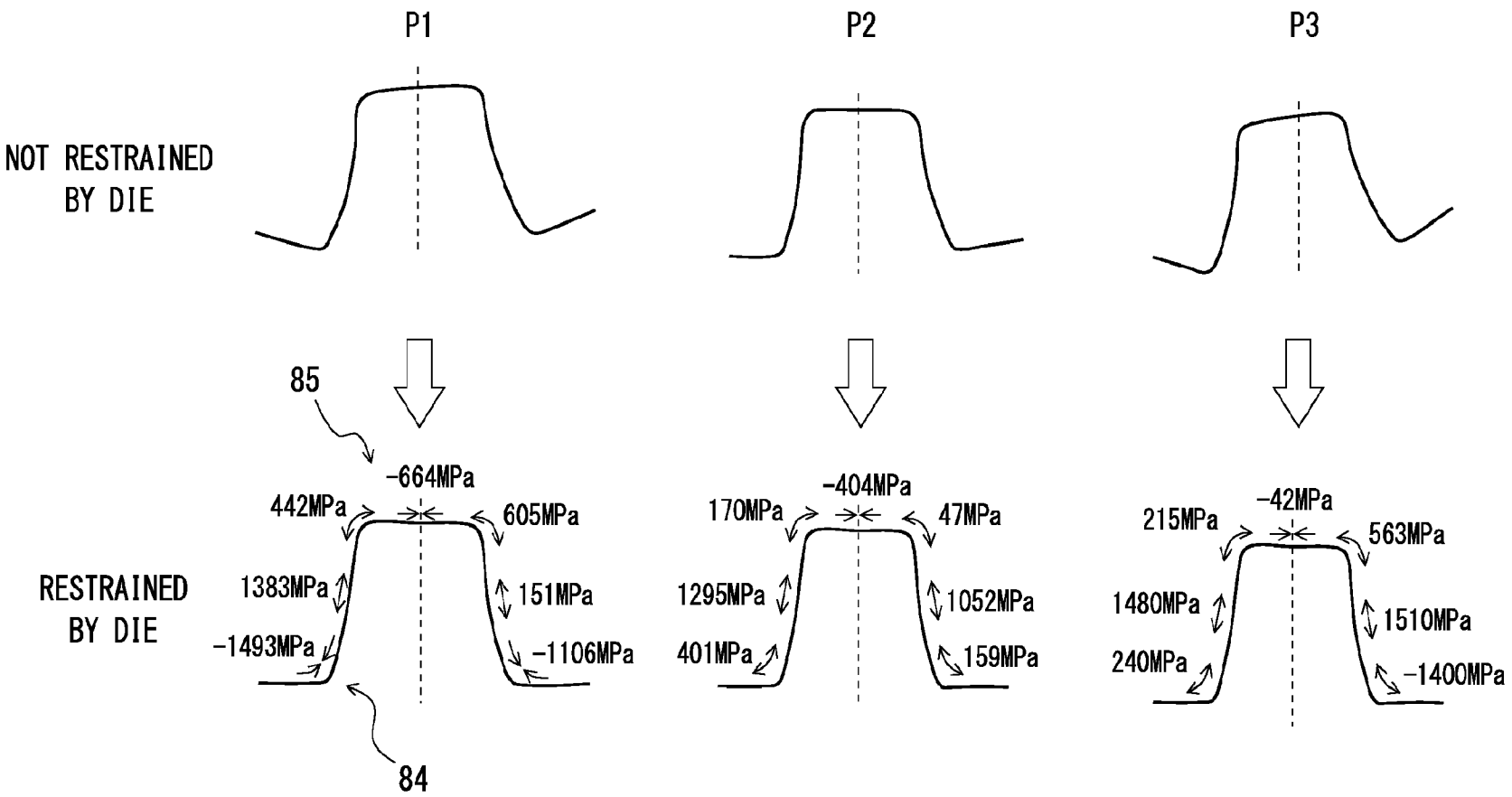
FIG. 12 is a cross-sectional diagram for explaining an example of stresses generated in workpieces (in a restrained state)

A result of an examination of stresses generated in, for example, a workpiece 80 shown in FIG. 11 is shown in FIG. 12. The left drawing of FIG. 11 is a top view of the workpiece 80, and the right drawing of FIG. 11 is a cross-sectional diagram of the workpiece 80. A curved part 81 is formed in the workpiece 80. The upper drawings of FIG. 12 indicate a state in which the workpiece is not restrained by a die, while the lower drawings of FIG. 12 indicate a state in which the workpiece is restrained by the die. When the workpiece 80 is restrained by the die, stresses that are applied at positions P1, P2 and P3 of FIG. 11 are shown on corresponding cross-sections P1, P2, and P3, respectively, of FIG. 12.

Turning to, for example, a curved part 84 (see FIG. 12) on a cross-section of the workpiece, the compressive stress (−1493 MPa: the compressive stress is indicated by a negative sign) is generated on the cross-section P1, while the tensile stresses (401 MPa and 240 MPa) are generated on the cross-sections P2 and P3, respectively. Turning now to a top 85 of the workpiece, the compressive stresses are generated on all cross-sections P1 to P3. The size of the compressive stress is the greatest (−664 MPa) on the cross-section P1 and the smallest (−42 MPa) on the cross-section P3. As described above, distribution of the generated stresses differs according to the positions on the cross-sections in the same workpiece 80. In this exemplary embodiment, the stress distribution on each cross-section may be calculated, and the conditions for the shot peening may be changed for each cross-section according to the stress distribution on each cross-section.

Figure 13:
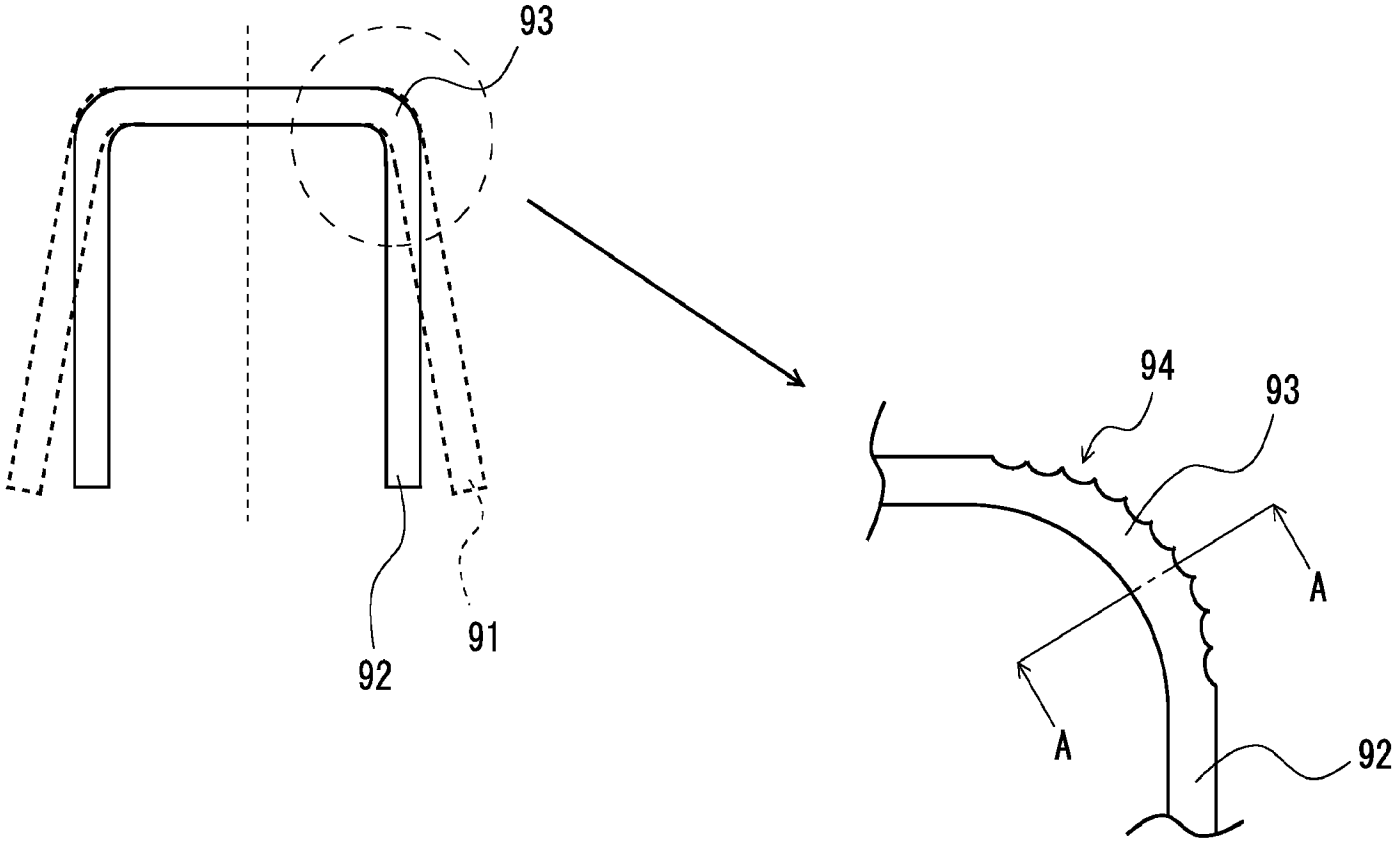
FIG. 13 is a cross-sectional diagram showing a shot peened workpiece.

In this exemplary embodiment, the shot peening may be performed in such a way that residual stresses on the inner side and outer side of the curved part of the workpiece will become the compressive stress. As shown in FIG. 13, for example, when the shot peening is performed on a curved part 93 of a workpiece 91 where the springback is generated in such a way that impressions 94 are formed on an outer side of the curved part 93 of a shot peened workpiece 92, compressive residual stresses can be generated in each of the inner side and outer side of the curved part 93.

More specifically, when the impressions 94 are formed on the outer side of the curved part 93 of the workpiece 92 by the shot peening, the outer side of the curved part 93 is extended, thereby generating the compressive residual stresses in the outer side of the curved part 93. At this time, the inner side of the curved part 93 of the workpiece becomes a state that is bent inwardly and will become a compression field. Accordingly, the compressive residual stresses are generated in the inner side and outer side of the curved part 93 of the workpiece. In this way, by making the residual stresses in the inner side and outer side of the curved part of the workpiece become the compressive stresses, it is possible to prevent a crack from occurring in the workpiece, thereby preventing a fatigue failure and a delayed failure caused by the crack.

Figure 14:
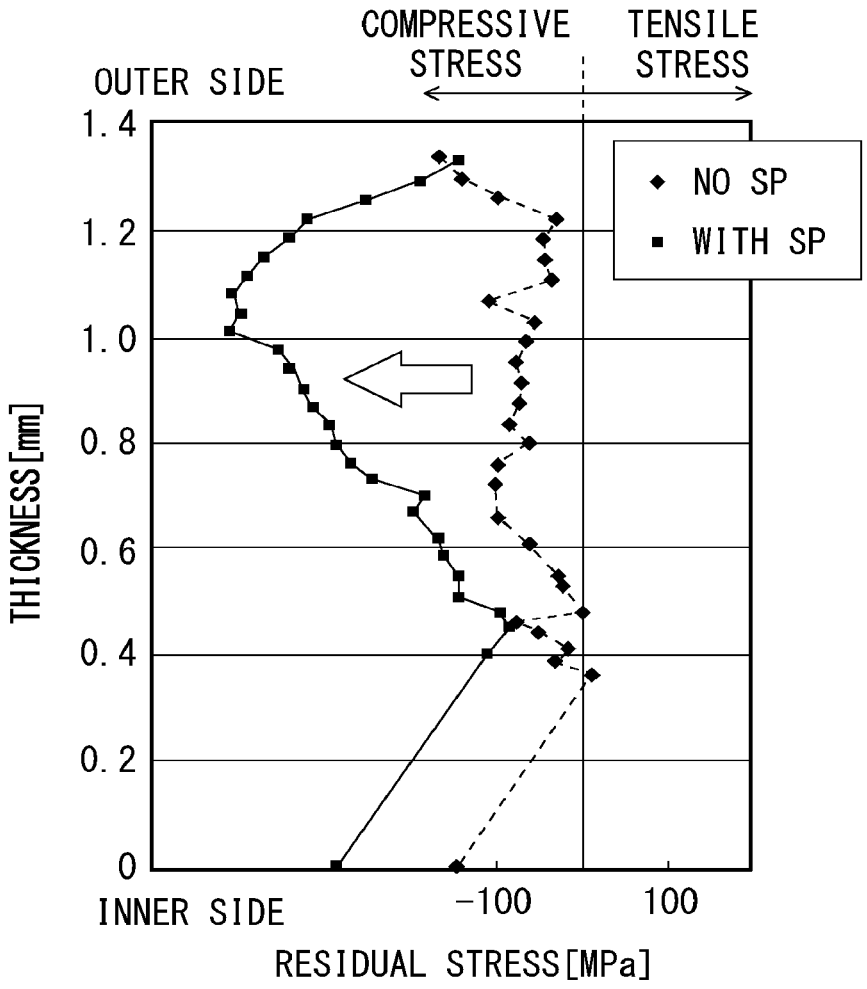
FIG. 14 is a graph showing a residual stress in a cross-section taken along the line A-A of FIG. 13.

FIG. 14 is a graph showing the residual stress on the cross-section taken along the line A-A of FIG. 13. The graph shown in FIG. 14 indicates the residual stress in a thickness direction. As shown in FIG. 14, when the shot peening (SP) is performed, the residual compressive stress in the curved part 93 of the workpiece 92 is greater than that when the shot peening is not performed. Therefore, it is possible to prevent a fatigue failure and a delayed failure caused by a crack when the shot peening is performed.

Figure 15:
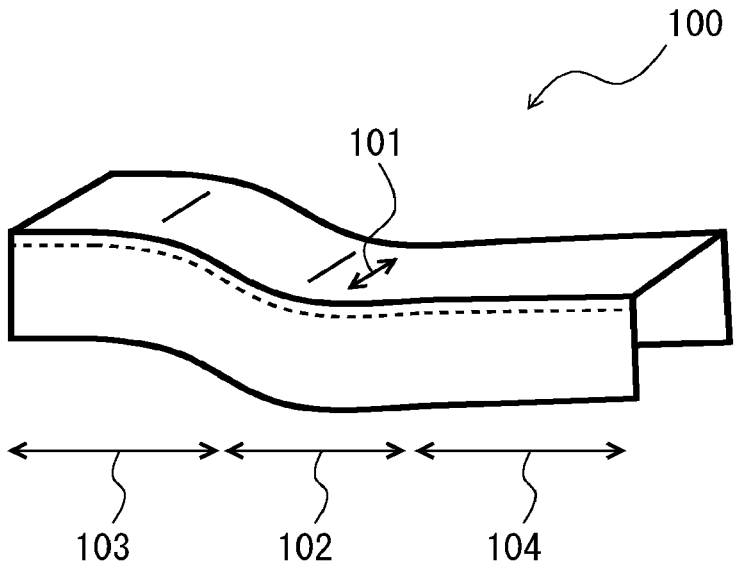
FIG. 15 is a drawing for explaining an order to perform the shot peening.

Further, in this exemplary embodiment, when the shot peening is performed on a stamped workpiece, an order of the shot peening may be the one described as follows. FIG. 15 is a drawing for explaining the order of the shot peening. As shown in FIG. 15, when the shot peening is performed on a workpiece 100, the shot peening is performed firstly on a top 101, and then the shot peening is performed on both side faces of a central part 102, both side faces of an end part 103, and both side faces of an end part 104 in this order. When the shot peening is performed in this order, a material can be moved from a side of the central part 102 to sides of the end parts 103 and 104 to which it is difficult to move the material, thereby enabling the workpiece to be appropriately conformed to a jig with an appropriate dimension.

EXAMPLE 1

Next, an example 1 of the present invention shall be explained as follows.

Figure 16:
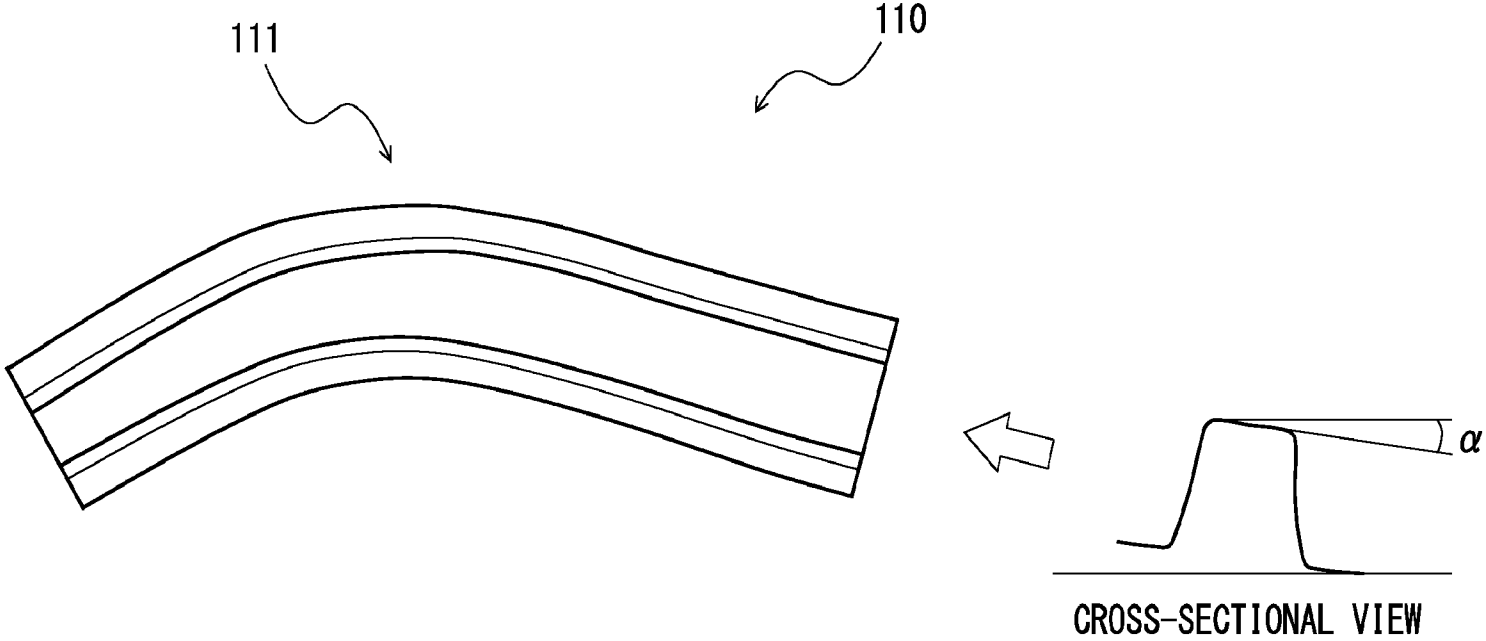
FIG. 16 is a drawing for explaining an effect of the shot peening (an example 1)

Using an ultra high tensile strength steel having a thickness of 1.4 mm (tensile strength is 1180 MPa), a hat-shaped part having a two-dimensional curvature was formed. The part formed in this way is shown in FIG. 16. In FIG. 16, the left drawing is a top view of a workpiece 110, and the right drawing is a cross-sectional diagram of the workpiece 110. As shown in FIG. 16, the workpiece 110 had a curved part (two-dimensional curvature) 111.

After the workpiece 110 was stamped, a twist in the workpiece 110 (i.e. a twist $\alpha$ with respect to a horizontal face) in the case where the shot peening was performed and that in the case where the shot peening was not performed were measured. Conditions of the shot peening were: a diameter of a shot material was $\phi$2.5 mm; a hardness of the shot material (Rockwell hardness) was HRc 40 to 50; a shot pressure was 0.3 MPa; a diameter of a nozzle for discharging the shot material was $\phi$10 mm; and an irradiated area was $\phi$25 mm. When the shot peening was performed, a jig having an appropriate dimension was placed at an inner side of the workpiece 110.

When the shot peening was not performed after the workpiece 110 was stamped, the twist $\alpha$ with respect to the horizontal face of the workpiece 110 was ten degrees. On the other hand, when the shot peening was performed after the workpiece 110 was stamped, the twist $\alpha$ with respect to the horizontal face of the workpiece 110 was two degrees. In sum, the shot peening after the stamping reduced the twist in the workpiece 110.

EXAMPLE 2

Figure 17:
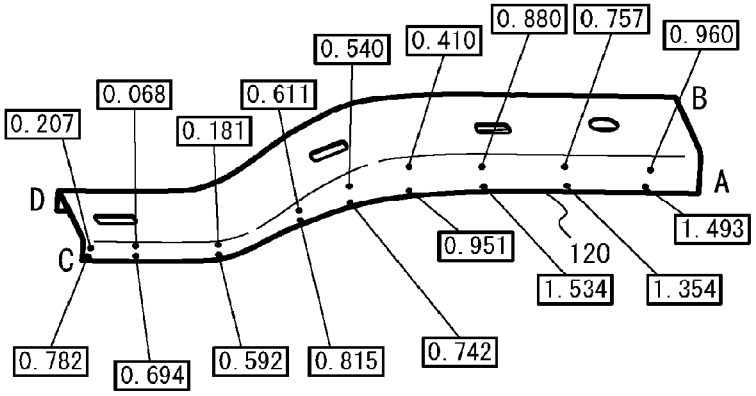
FIG. 17 is a drawing for explaining an effect of the shot peening (an example 2)
Figure 17:
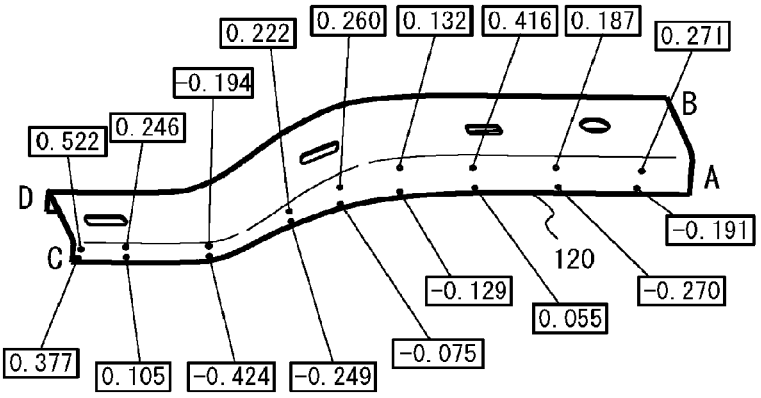
Figure 18:
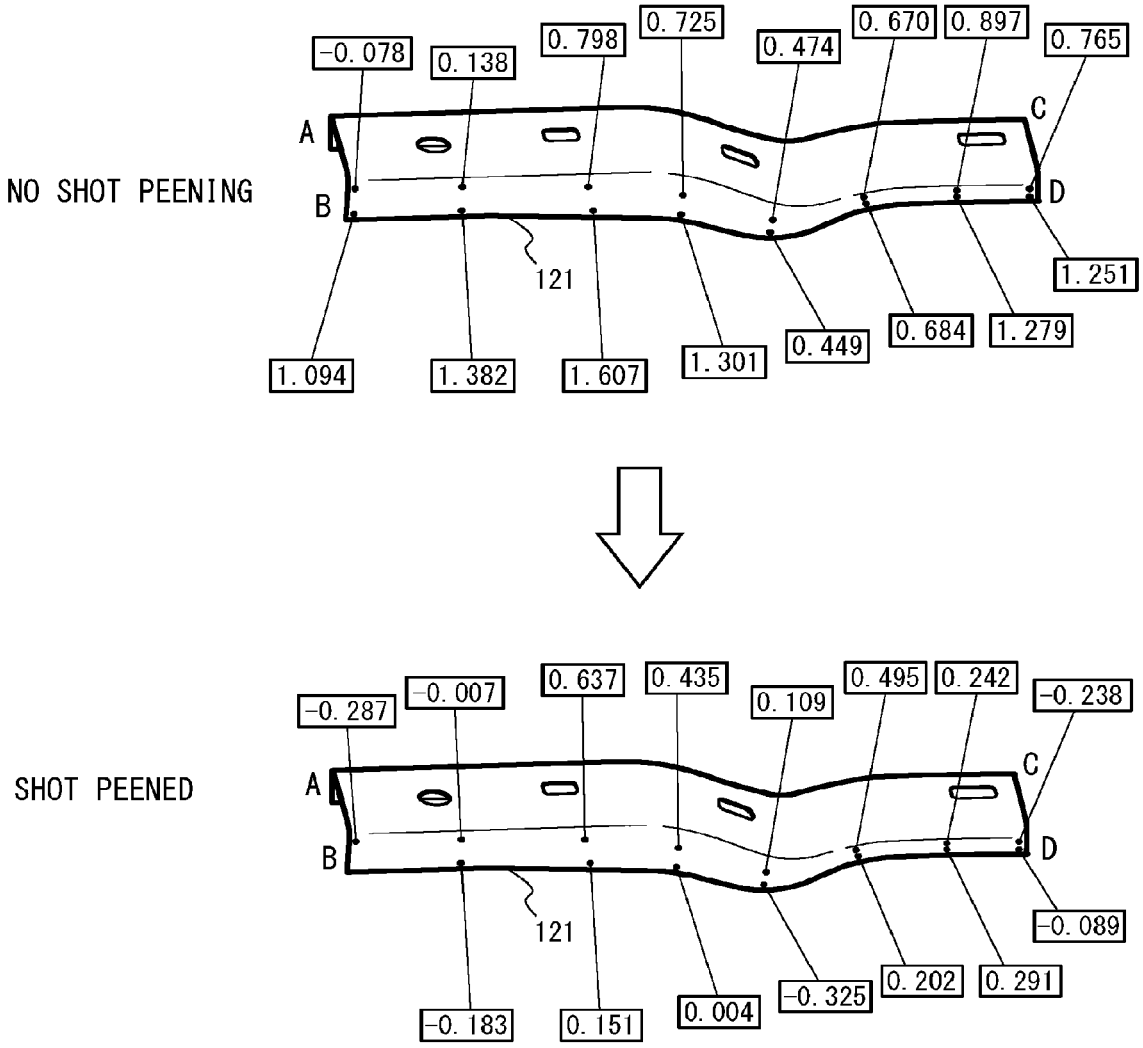
FIG. 18 is a drawing for explaining an effect of the shot peening (the example 2).

Next, an example 2 of the present invention shall be explained as follows. Using an ultra high tensile strength steel having a thickness of 2.6 mm (tensile strength is 780 MPa), a part having a three-dimensional curvature was formed. FIGS. 17 and 18 are perspective diagrams of the part formed at this time. Note that FIG. 18 is a drawing in which the part shown in FIG. 17 is viewed from the opposite side (from the back of the workpiece) (corresponding corners are marked by letters A, B, C, and D).

After a workpiece was stamped, a dimensional error in the workpiece 110 (i.e. a deviation from an appropriate dimension) in the case where the shot peening was performed (an upper drawing) and that in the case where the shot peening was not performed (a lower drawing) were measured. Conditions of the shot peening were: a diameter of a shot material was $\phi$2.5 mm; a hardness of the shot material (Rockwell hardness) was HRc 40 to 50; a shot pressure was 0.3 MPa; a diameter of a nozzle for discharging the shot material was $\phi$10 mm; and an irradiated area was $\phi$25 mm. When the shot peening was performed, a jig having an appropriate dimension was placed at an inner side of the workpiece.

As shown in the upper drawings of FIGS. 17 and 18, when the shot peening was not performed, the dimensional error on the side face of the workpiece was large. The dimensional error was large especially at tips 120 and 121 of side parts of the workpiece. In other words, the springback was generated in the workpiece shown in the upper drawings of FIGS. 17 and 18.

In the case when the shot peening was performed after the workpiece was stamped, as shown in the lower drawings of FIGS. 17 and 18, the dimensional error was small on the side face of the workpiece. More specifically, a surface accuracy improved from 1.5 mm to 0.64 mm (0.37 mm to −0.27 mm). The improvement in the dimensional error was especially large at the tips 120 and 121 of the side parts of the workpiece. In other words, the springback was corrected by performing the shot peening.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A method of shot peening comprising:

placing a jig having an appropriate dimension at one face side of a stamped workpiece; and performing shot peening on another face side of the workpiece in a state where the jig is placed at the one face side of the workpiece, and conforming the workpiece to the jig and thereby bringing the workpiece into contact with the jig so that no gap is formed between the workpiece and the jig.

2. The method according to claim 1, wherein when the jig is placed at an inner side of a curved part of the workpiece, and a radius of curvature of the curved part of the workpiece is greater than that of a curved part of the jig, the shot peening is performed on an outer side of the curved part of the workpiece under a condition that the outer side of the curved part of the workpiece is extended.

3. The method according to claim 2, wherein the condition of the shot peening is such that an impression depth on a surface of the workpiece become greater than or equal to 0.1 mm and less than 0.3 mm.

4. The method according to claim 1, wherein when the jig is placed at an outer side of a curved part of the workpiece, and a radius of curvature of the curved part of the workpiece is greater than that of a curved part of the jig, the shot peening is performed on an inner side of the curved part of the workpiece under a condition that the outer side of the curved part of the workpiece is extended.

5. The method according to claim 4, wherein the condition of the shot peening is such that an impression depth on the surface of the workpiece will become greater than or equal to 0.3 mm.

6. The method according to claim 1, wherein a stress for forming the stamped wofkpiece to become a workpiece with the appropriate dimension is calculated using a dimensional difference of the stamped workpiece from the appropriate dimension, and the shot peening is performed under a condition that the calculated stress is applied on the stamped workpiece.

7. The method according to claim 1, wherein the shot peening is performed so that residual stresses in an inner side and an outer side of a curved part of the workpiece will become compressive stresses.

* * * * *